US005193479A

United States Patent [19]

Bielefeld

[11] Patent Number: 5,193,479

[45] Date of Patent: Mar. 16, 1993

[54] APPARATUS FOR LIFTING AND STORING A DINGHY OR THE LIKE

[76] Inventor: Rolf J. Bielefeld, 2715 Knight Dr., Troy, Mich. 48098

[21] Appl. No.: 699,167

[22] Filed: May 13, 1991

[51] Int. Cl.[5] ..... B63B 23/32

[52] U.S. Cl. ..... 114/366; 114/44; 114/259; 114/376

[58] Field of Search ..... 114/365, 366, 375, 376, 114/259, 44; 414/678

[56] References Cited

U.S. PATENT DOCUMENTS

| | | | |
|---|---|---|---|
| 3,143,991 | 8/1964 | Anderson | 114/365 |
| 3,401,806 | 9/1968 | Schmit | 414/678 |
| 4,763,593 | 8/1988 | Lasko | 114/44 |
| 4,864,951 | 9/1989 | Koepp | 114/44 |
| 4,964,358 | 10/1990 | Sandrow | 114/365 |

*Primary Examiner*—Joseph F. Peters, Jr.
*Assistant Examiner*—Thomas J. Brahan
*Attorney, Agent, or Firm*—Dykema Gossett

[57] ABSTRACT

Apparatus for lifting and storing a dinghy or similar watercraft on the transom or swim platform of a larger boat includes a substantially U-shaped cradle secured to the swim platform by means of pivoting arms providing an over-center arrangement in which the cradle may be swung from a deployed position behind the swim platform to an over-center, storage position in which essentially the entire weight of the cradle and the dinghy is transferred to the swim platform while the dinghy remains in essentially a horizontal position.

13 Claims, 3 Drawing Sheets

APPARATUS FOR LIFTING AND STORING A DINGHY OR THE LIKE

TECHNICAL FIELD

The present invention broadly relates to devices for lifting small boats from the water, and more particularly to an apparatus for lifting and storing a dinghy or the like, especially on the transom or swim platform of a larger boat.

BACKGROUND OF THE INVENTION

Various devices have been proposed in the past for lifting and storing dinghies or other small boats on larger boats. Typically, the dinghy is often mounted at the rear or stern of the larger boat, extending transversely across the larger boat's transom and/or swim platform.

One approach to lifting and storing a dinghy on the transom or swim platform of the larger boat involves the provision of davits which consist of a pair of arms extending rearwardly from the larger boat's transom so as to overhang the water; lines or cables fed through pulleys on the davits are connected with the dinghy, and a winch or the like is provided to pull the dinghy upwardly away from the water so as to be suspended beneath the davits.

Several other lifting and storage devices have also been proposed as an alternative to the davit approach. Examples of these other approaches may be found in the following U.S. Pat. Nos.:

| U.S. Pat. No. | Issue Date | Inventor |
|---|---|---|
| 2,294,864 | 9/1/42 | G. E. Palmer |
| 3,143,991 | 8/11/64 | R. C. Anderson |
| 3,442,241 | 5/6/69 | G. H. Daunis |
| 3,690,282 | 9/12/72 | L. H. Busby |
| 4,850,295 | 7/25/89 | R. J. Weaver |
| 4,864,951 | 9/12/89 | O. W. Coepp, Jr. |
| 4,878,450 | 11/7/89 | A. Schmidt, Jr. |

Each of the devices disclosed in the patents listed above possess one or more inadequacies. For example, some of these prior art devices include attachment mechanisms that must be permanently secured to the dinghy, thus complicating the mechanism and requiring permanent alteration of the structure of the dinghy. In other cases, the prior art devices require major structural modification of the transom or swim platform of the larger boat. A further major drawback of the prior art dinghy lifting and storage devices resides in the fact that they are not suitable for lifting and storing a dinghy which has an outboard motor attached thereto. Some of the prior art devices provide for swinging of the dinghy out of the water to an essentially vertical position; this requires an inordinate amount of force to swing the dinghy upwardly, owing in part to the additional weight of the outboard motor, and necessarily requires that the contents of the dinghy (e.g., gas tanks, ect.) be removed prior to the lifting operation. In addition to the need for exerting substantial additional force to lift the dinghy, these prior art devices are particularly awkward to operate and often obstruct the rear of the transom and/or swim platform to a degree that exacerbates the awkwardness of dinghy lifting or deploying operations.

There is therefore a clear need in the art for a dinghy lifting and storage apparatus which permits lifting and storing a dinghy, especially with a motor and fuel tank, in a horizontal position which obviates the need for tilting the dinghy, is easy to operate with a minimum of effort and is quick and easy to manipulate. The present invention is intended to satisfy this need.

SUMMARY OF THE INVENTION

According to the present invention, apparatus is provided for lifting and storing a dinghy on the transom or swim platform of a larger boat. The apparatus broadly includes a cradle for receiving and supporting the dinghy, and pivot arm means for pivotally mounting the cradle on the platform for movement between a dinghy launching position and a dinghy storage position wherein the pivot arm means extend between and is pivotally coupled with the cradle and the platform. The pivot arm means preferably includes a pair of transversely spaced apart pivot arms, each including an arcuate portion and having a pivot on each of the opposite ends thereof so as to permit the cradle to pivot about multiple pivot points when the cradle is moved between the dinghy launching and dinghy storage positions. One end of each of the pivot arms is preferably mounted on the bottom of a swim platform extending rearwardly from the transom. The cradle includes a cross member extending generally parallel to the platform and the other, opposite ends of the pivot arms are connected pivotally to this cross member. Each of the pivot arms includes an elongate portion connected with the arcuate portion, the elongate portion being disposed below the platform level when the cradle is in the dinghy launching position thereof. The apparatus further includes means for shifting the cradle from the dinghy launching position to the dinghy storage position. The pivot arm means includes an over-center arrangement and the cradle includes means for engaging the pivot arms to limit the movement of the cradle when the pivot arms have been swung to their over-center position. The cradle may be easily swung to its over-center position simply by the user lifting one end of the cradle nearest the transom or swim platform of the larger boat. This over-center movement displaces one side of the cradle upwardly away from the water. The other side of the cradle is moved upwardly through lifting means in the nature of a block and tackle assembly or the like. When the cradle is empty and not in use, it may be swung to an essentially vertical position to facilitate backing the larger boat toward a dock or the like.

BRIEF DESCRIPTION OF THE DRAWINGS

In the drawings, which form an integral part of the specification and are to be read in conjunction therewith, and wherein like reference numerals are employed to designate like components of the various views.

DESCRIPTION OF THE PREFERRED EMBODIMENTS

Figure 1:
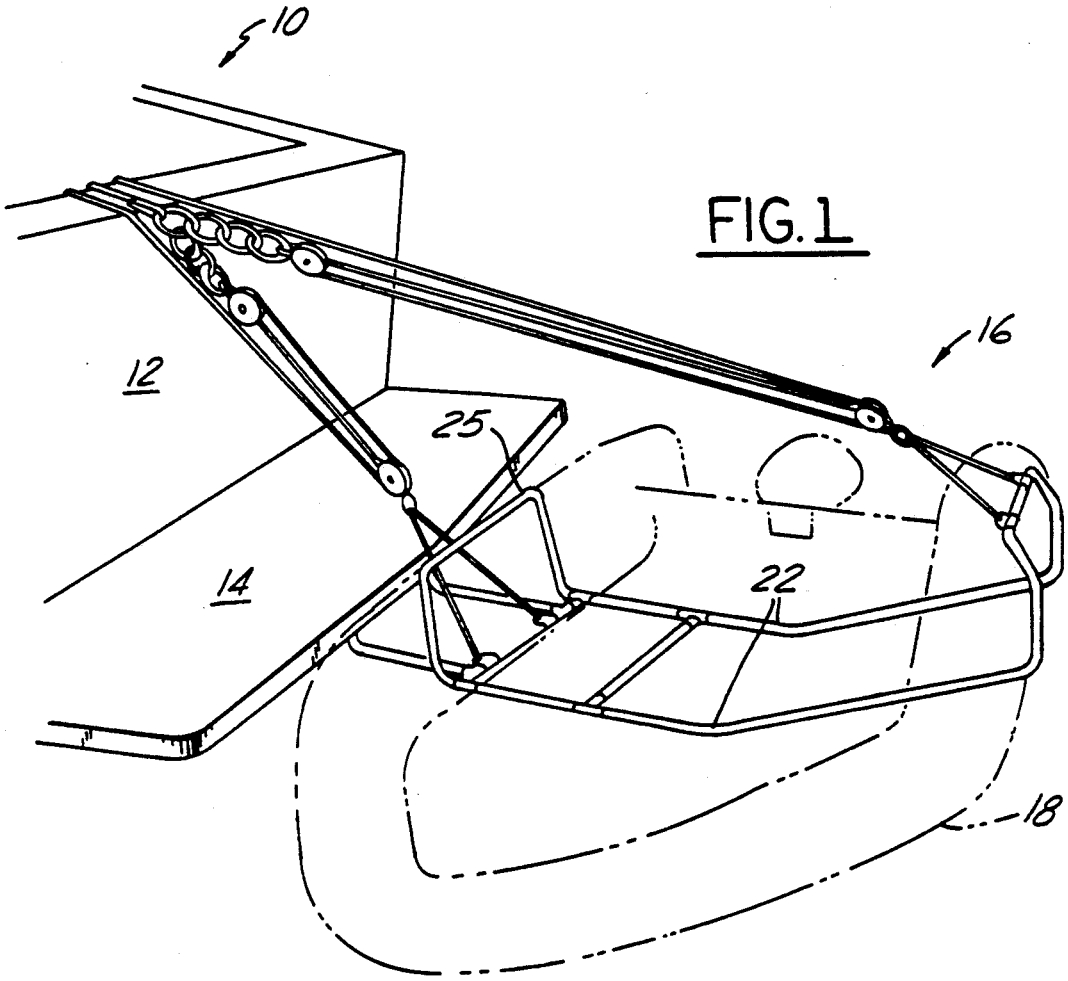
FIG. 1 is a perspective view of apparatus for lifting and storing a dinghy or the like on a larger boat, forming the preferred embodiment of the present invention, shown in operative relationship to the larger boat, with the apparatus in a lowered dinghy-launching position, the dinghy being shown in the phantom.

Referring first to FIGS. 1–5, the present invention is broadly concerned with an apparatus, generally indicated by the numeral 16 for lifting and storing a small boat such as a dinghy 18 or the like at the rear of a larger boat 10, transversely across the transom 12 and/or swim platform 14 of the larger boat 10. The dinghy 18 may be of any of various types, including those having hard walls and sides, rubber sides "inflatable" boats, and indeed the present apparatus may be used to lift and store other small watercraft, including "jet skis", personal watercraft and "jet bikes". The particular embodiment of the invention disclosed herein is shown mounted on a swim platform, however, it is to be understood that the apparatus of the present invention may also be mounted by means of suitable brackets, directly on the transom 12 of the larger boat 10. Thus, for purposes of the present disclosure and appended claims, the swim platform 14 and transom 12 shall be considered equivalents of each other.

Figures 3, 4, 5:
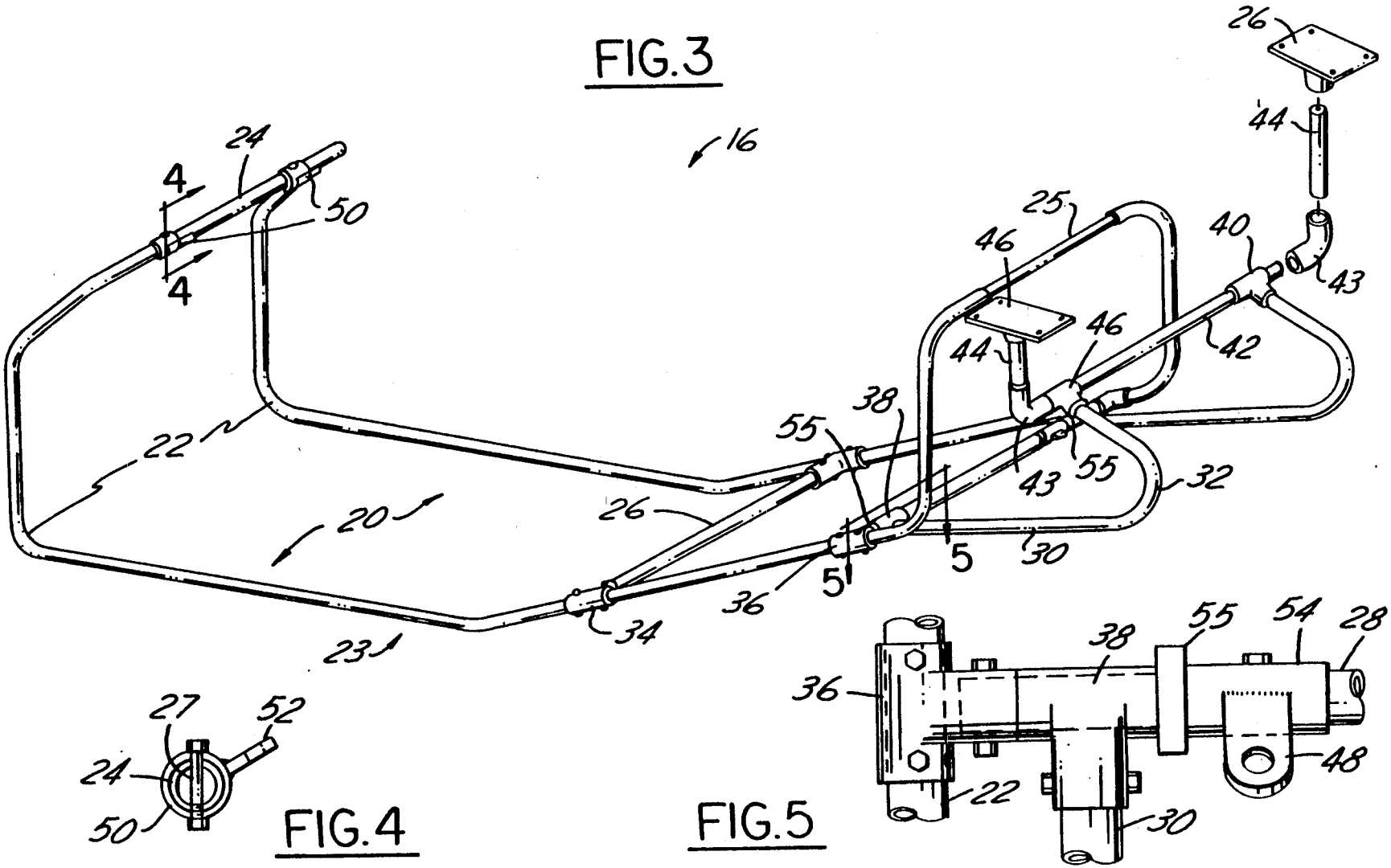
FIG. 3 is a perspective view of the apparatus of the present invention, shown removed from the larger boat for purposes of clarity.
FIG. 4 is a sectional view taken along the line 4—4 in FIG. 3.
FIG. 5 is a fragmentary view taken in the direction of the arrows 5—5 in FIG. 3.

As best seen in FIG. 3, the apparatus 16 broadly includes a generally U or V-shaped cradle 20 secured to the swim platform 14 by means of a pair of pivot arms 30. The various components of the apparatus 16 described hereinbelow are preferably formed of rigid, noncorrosive material such as stainless steel, but may alternatively be formed of synthetic material such as plastic. The cradle 20 includes a pair of spaced apart cradle arms 22 having a bend 23 near the middle area thereof. The outer ends of the cradle arms 22 extend upwardly, with the trailing end also extending somewhat forwardly and inwardly so as to overlie one side of the dinghy 18. At the trailing end, the cradle arms 22 are connected with each other by means of a cradle cross bar 24. A pair of spaced apart connectors 50 provided with fastening lugs 52 are sleeved over the cross bar 24 and secured in place by means of a bolt and nut 27.

A pivot limiter arm 26 on one side of the cradle 20 extends between and is secured to the cradle arms 22 by means of T-connections 34. The forward ends of the cradle arms 22 are connected by a second cradle cross bar 25. At one end of the cradle 20 adjacent the swim platform 14, there is provided a cradle hinge bar 28 which extends between the cradle arms 22 and is secured to cradle arms 22 by a pair of T-connections 36. The essentially straight, forwardly extending (in FIGS. 1 and 3) portions of a pair of pivot arms 30 are secured to T-connectors 38 which are in turn journalled for rotation on the hinge bar 28, thus pivotally mounting the entire cradle 20 on the pivot arms 30. Each of the pivot arms 30 includes an arcuate portion 32, the end of which is secured to a transversely extending stabilizer bar 42 by means of T-connections 40. The stabilizer bar 42 is journalled for rotation between a pair of elbows 43. The elbows 43 are connected via stanchion bars 44 to mounting flanges 46. The mounting flanges 46 are secured to the bottom side of the swim platform 14. From the foregoing, it may be appreciated that the cradle is independently pivotable about first and second axes respectively longitudinally through the hinge bar 28 and the stabilizer bar 42.

As may be best seen in FIG. 3, the pivot arms 30 are disposed inboard of the cradle arms 22. A pair of spaced apart fittings 54 on the hinge bar 28 are provided with fastening lugs 48, each of which includes the fastening aperture for purposes later discussed. A pair of resilient bushings 55 formed of rubber or the like are sleeved over the bar 28, between the fittings 54 and the T-connections 38, each of the bushings 55 having a diameter substantially larger than that of fittings 54 or T-connections 38.

Figure 2:
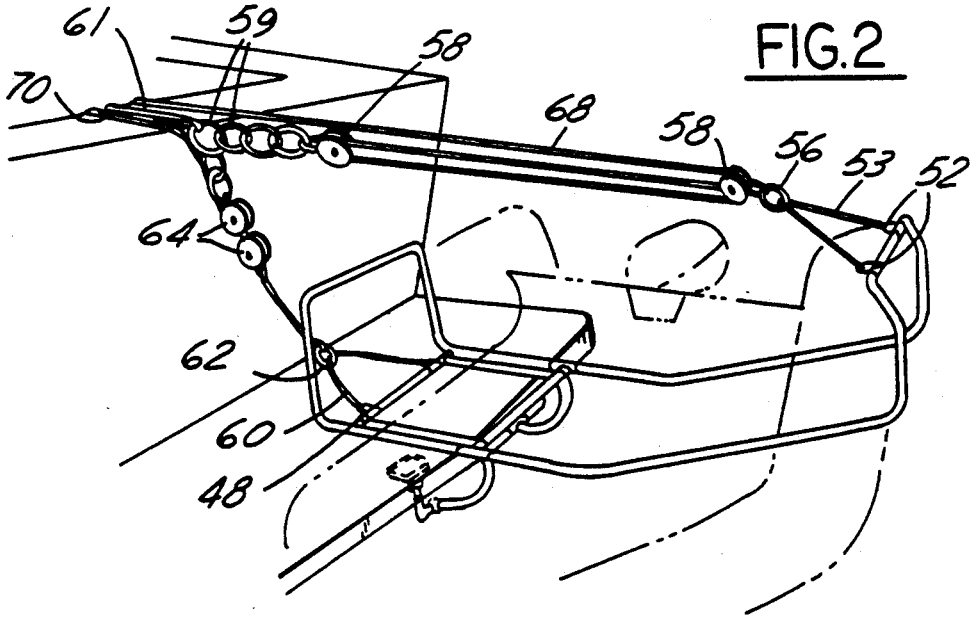
FIG. 2 is a perspective view similar to FIG. 1, but showing the cradle having been swung upwardly to its stored position.

As best seen in FIGS. 1 and 2, a block and tackle assembly secured to the transom 12 of the boat 10 provides a means of lifting and shifting the cradle 16 from a deployed position as shown in FIG. 1 in which the dinghy 18 may be launched, to a storage position shown in FIG. 2 in which the dinghy 18 is elevated above water level 73 (FIGS. 6–9) and is supported in large part on the swim platform 14, in essentially a horizontal position. The block and tackle assembly mentioned above includes a pull line 68 trained around a pair of pulleys 58 which are in turn secured by an eye 56 to a connecting line 53. The ends of the connecting line 53 are provided with snap hooks which snap through the apertures in the fastening lugs 52. In a similar manner, a second pull line 70 is trained around a pair of pulleys 64, which is connected via an eye 62 to fastening lines 60. Fastening lines 60 are in turn secured by snap hooks through the apertures in the fastening lugs 48. Lines 68 and 70 are secured within and are accessed from the cockpit of the boat 10, behind the transom 12. However, these latter mentioned lines may be secured anywhere on the transom. One of each of the pulleys 58, 64 are secured together via a chain 59 which is in turn secured to the transom 12 via a third line 61.

As shown in FIG. 1, with the apparatus 16 in the deployed position, the cradle 20 is essentially below the bottom of the swim platform 14, and partially below the water line 73 (FIGS. 6–9) so that the dinghy 18 may be simply floated transversely into or out of the cradle 20. As shown in FIG. 1, with the cradle 20 swung to its deployed position, the pivot arms 30 are swung to their lower position so as to space the cradle rearwardly behind the swim platform 14. Although the sequence of movements of the various parts of the apparatus 16 will be described in more detail below, a brief description is appropriate at this point. Assuming that the dinghy 18 has been floated into the cradle 20, the user pulls on the line 70, thereby applying an upwardly and forwardly directed force on the hinge bar 28. This force causes the hinge bar 28, and thus the outer ends of the pivot arms 30 and the forward end of the cradle 20 to swing upwardly and forwardly until the forward end of the cradle 20 is positioned immediately above the swim platform 14. Near the end of this motion as the forward end of the cradle moves down toward the top of the swim platform 14, the pivot limiter arm 26 engages the pivot arms 30 to limit movement of the cradle 20 and, during the final stage of this motion the protective rubber bushings 55 engage the top of the swim platform 14.

Thus, as shown in FIG. 2, it may be appreciated that in the storage position, the dinghy 18 is disposed essentially horizontally, and a substantial amount of the weight of the dinghy 18 and cradle 20 is transmitted via arm 26 and pivot arms 30 to the mounting flanges 46. In order to move the rear or trailing end of the cradle upwardly so as to lift the dinghy above the water line, the user draws in line 68, thus causing the trailing end of the cradle 20 to swing upwardly about a pivot axis established by the stabilizer bar 42.

From the foregoing description, it may be appreciated that the pivot arms 30 and the pivotal connections established by the stabilizer bar 42 and hinge bar 28 provide an over-center mechanism such that when the forward side of the cradle 20 is pivoted upwardly and forwardly from the position shown in FIG. 1 to the position shown in FIG. 2, the hinge bar travels over-center to the stable position shown in FIG. 2.

Figure 6:
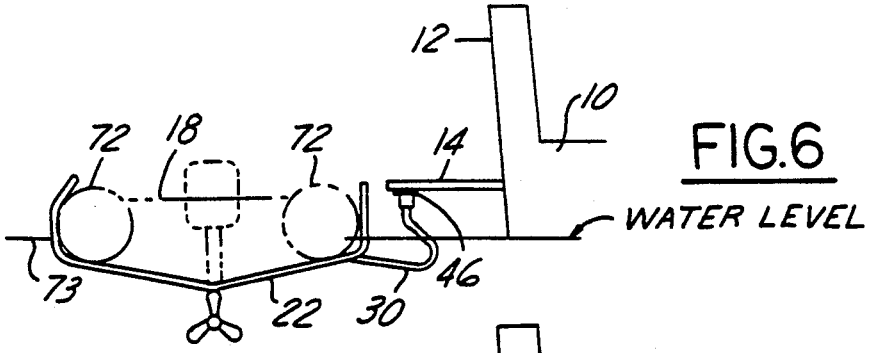
FIGS. 6–9 are diagrammatic views of the apparatus shown in FIG. 1, depicting successive steps in lifting the dinghy out of the water into a storage position.
Figure 7:
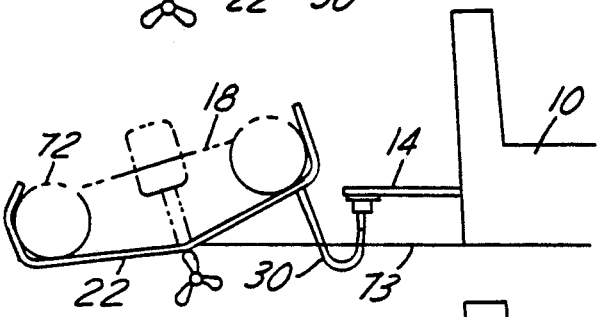
Figure 8:
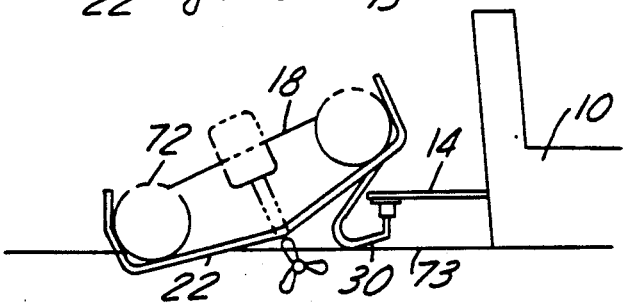
Figure 9:
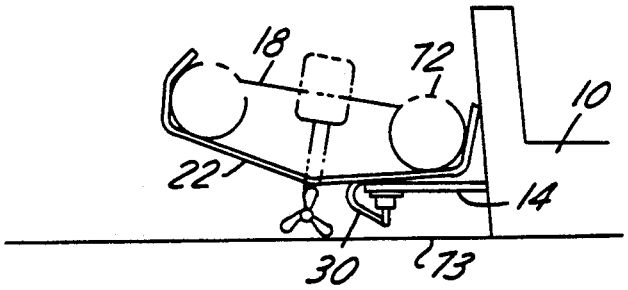
Figure 10:
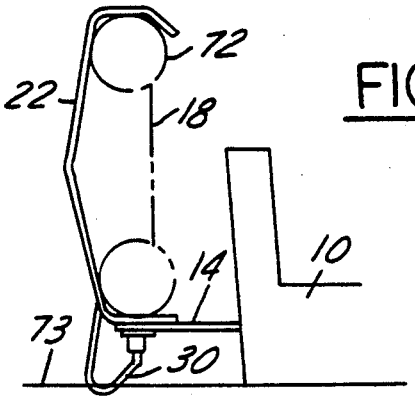
FIG. 10 is a diagrammatic, side view of the apparatus shown swung to an intermediate, essentially vertical position; and, FIG. 11 is a view similar to FIG. 10, but showing the cradle having been moved to its compact, vertical storage position.
Figure 11:
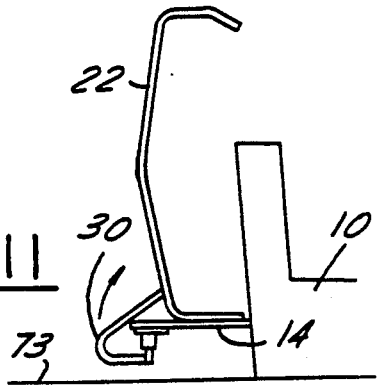

The above-described movements may be better appreciated from FIGS. 6–9. As shown in FIG. 6, the dinghy 18 has been floated into the cradle 22, such that the forward and trailing ends of the arms 22 contact and tend to capture the side wall tubes 72 of the dinghy 18. In this position, the straight sections of the pivot arms 30 may be seen to extend rearwardly so as to space the cradle 20 somewhat rearwardly from the swim platform 14. The next step in the process from shifting the cradle 20 from the deployed to the storage position involves drawing in the line 70 which pulls the hinge bar upwardly and forwardly so that the forward end of the cradle 20 likewise moves upwardly above the water level into partially overlapping relationship to the top of the swim platform 14. It should also be noted here that, depending upon the loading of the dinghy 18, the movement shown in FIGS. 7 and 8 may be simply effected by simply grasping the cross bar 25 and pulling it upwardly and forwardly, thus eliminating the need for drawing in the line 70 to produce this effect. Finally, as shown in FIG. 9, the rear end, e.g., crossbar 24 is pulled forwardly via the line 68, causing the cradle 20 to pivot about the stabilizer bar 42 to an over-center position so as to tilt the rear end of the cradle 20 out of the water, thus shifting the entire weight of the cradle 20 and the dinghy 18 onto the swim platform 14. In those cases where it is desired to minimize the rearward extension of the apparatus 16 and it is not necessary to maintain the dinghy 18 in a level or horizontal position or the dinghy is absent, the cradle 20 may be swung to an essentially vertical storage position as shown in FIG. 10 and then forwardly as shown in FIG. 11, so that the forward end of the cradle arms and the cross bar 25 rest on top of the swim platform 14. This feature further minimizes the rearward displacement of the apparatus 16, thus permitting the boat 10 to be backed closer to docks and the like.

From the foregoing, it may be appreciated that the apparatus of the present invention not only provides for the reliable accomplishment of the objects of the invention but does so in a particularly simple and effective manner. It is recognized, of course, that those skilled in the art may make various modifications or additions to the preferred embodiment chosen to illustrate the invention without departing from the spirit and scope of the present contribution to the art. For example, the apparatus of the present invention may be mounted directly on the transom 14 simply by means of a suitable pair of rearwardly extending, transversely spaced adapter brackets (not shown) which are secured directly to the transom 12. Accordingly, it is to be understood that the protection sought and to be afforded hereby should be deemed to extend to the subject matter claimed and all equivalents thereof fairly within the scope of the invention.

What is claimed is:

1. Apparatus for storing a dinghy on a transom-mounted swim platform of a boat, comprising:

a cradle for receiving and supporting said dinghy;

pivot arm means for pivotally mounting said cradle on said platform for movement between a generally horizontal dinghy launching position and a generally horizontal dinghy storage position, said pivot arm means extending between and being pivotally coupled with each of said cradle and said platform, said pivot arm means including an over-center pivot connection with said cradle and beneath said dinghy, said pivot arms configured to permit said dinghy to remain generally horizontal during the entire movement of said cradle between said dinghy launching position and said dinghy storage position.

2. The apparatus of claim 1, wherein said pivot arm means includes a pair of transversely spaced apart pivot arms, each of said pivot arms including an arcuate portion and having said over-center pivot connection on one end thereof, and another pivot on the opposite end thereof whereby to permit said cradle to pivot about multiple pivot points when said cradle is moved between said dinghy launching and dinghy storage positions thereof.

3. The apparatus of claim 2, wherein said another pivot is mounted on the bottom side of said platform.

4. The apparatus of claim 3, wherein:

said cradle includes a cross member extending generally parallel to said platform, and said over-center pivot connection is located at said cross member.

5. The apparatus of claim 2, wherein:

each of said pivot arms includes an elongate portion connected with said arcuate portion, said elongate portion is disposed below said platform when said cradle is said dinghy launching position thereof, and said elongate portion is disposed above said platform when said cradle is in said dinghy storage position thereof.

6. The apparatus of claim 2, wherein said arcuate portion extends generally upwardly around the trailing edge of said platform when said cradle is in said dinghy storage position thereof.

7. The apparatus of claim 1, wherein said cradle includes limit means engagable with said pivot arm means for limiting the movement of said cradle when said cradle is moved to said storage position thereof.

8. The apparatus of claim 7, wherein:

said pivot arm means includes a pair of spaced apart pivot arms, and said limit means includes a cross member resting upon said pivot arms when said cradle is in said dinghy storage position thereof.

9. The apparatus of claim 8, wherein said pivot arms are mounted on the bottom side of said platform and are shaped to wrap around the trailing edge of said platform when said cradle is in said storage position thereof.

10. The apparatus of claim 1, including lifting means coupled between said cradle and said transom for lifting said cradle from said dinghy launching position toward said dinghy storage position.

11. Apparatus for removably mounting a dinghy or the like on the rear of a larger boat, comprising:

a cradle for supporting said dinghy;

means for shifting said cradle from a generally horizontal dinghy launching position to a generally horizontal dinghy storage position; and, connecting means between said larger boat and said cradle for causing said cradle to move upwardly and generally horizontally toward said larger boat when said shifting means shifts said cradle from said dinghy launching position to said dinghy storage position, said connection means including an over-center pivot arrangement having a portion connected to said cradle beneath said dinghy, said connecting means further including pivot arms configured to permit said dinghy to remain generally horizontal during the entire shifting movement of said cradle between said dinghy launching position and said dinghy storage position.

12. The apparatus of claim 11, wherein said over-center pivot arrangement includes a pair of spaced apart arcuate pivot arms each having the opposite ends thereof respectively pivotally connected to said cradle and to said larger boat.

13. The apparatus of claim 11, wherein said cradle includes limit means for engaging said pivot arms to limit the movement of said cradle.

* * * * *